United States Patent [19]

Pettersson

[11] Patent Number: 4,961,602

[45] Date of Patent: Oct. 9, 1990

[54] LATCH MECHANISM

[75] Inventor: Sven A. Pettersson, Santa Monica, Calif.

[73] Assignee: Adams Bite Products, Inc., Glendale, Calif.

[21] Appl. No.: 25,996

[22] Filed: Mar. 16, 1987

[51] Int. Cl.[5] ..... E05C 19/10

[52] U.S. Cl. ..... 292/98; 292/97

[58] Field of Search ..... 292/98, 100, 97, 132, 292/135, 185, 186, 187, 188

[56] References Cited

U.S. PATENT DOCUMENTS

| | | | |
|---|---|---|---|
| 2,742,309 | 4/1956 | Hillgren | 292/100 |
| 3,563,068 | 2/1971 | Dushane, Jr. | 292/98 X |
| 4,249,760 | 2/1981 | Conley | 292/98 X |
| 4,607,510 | 8/1986 | Shanaan et al. | 292/98 X |
| 4,618,174 | 10/1986 | Duke | 292/135 |

FOREIGN PATENT DOCUMENTS

| | | | |
|---|---|---|---|
| 2439321 | 2/1976 | Fed. Rep. of Germany | 292/98 |
| 222645 | 10/1924 | United Kingdom | 292/100 |
| 421993 | 1/1935 | United Kingdom | 292/188 |

*Primary Examiner*—Kenneth J. Dorner
*Assistant Examiner*—José V. Chen

[57] ABSTRACT

Disclosed is a latch mechanism particularly adapted to be used with helicopters or other structures subject to intensive vibrational forces. The latch mechanism includes a hook member which grasps a striker rod. The hook member is carried in a body member which has a recess therein for receiving the hook member. A groove provides access to the recess. The groove is along one edge of the body member and it receives the striker rod as the hook member pulls the striker rod inwardly. A pair of spaced apart curved openings in the hook member provide a cam for controlling the path of movement of the hook member so that the hook member moves between an open position and a closed position along a right angle path of travel. As the hook member changes direction, making a 90 degree turn as it moves along its path of travel, it pulls the striker rod inwardly to the locked position. An actuator arm is coupled to the hook member and moves rectilinearly within a channel in the body of the latch mechanism. The cam is designed to allow the actuator to move a predetermined distance to and fro after the hook member is in the locked position. Thus vibrational forces can act on the actuator element, moving it along a predetermined path of travel reciprocally without moving the hook member from the locked position. This safety feature minimizes or prevents accidental opening of the latch mechanism.

6 Claims, 4 Drawing Sheets

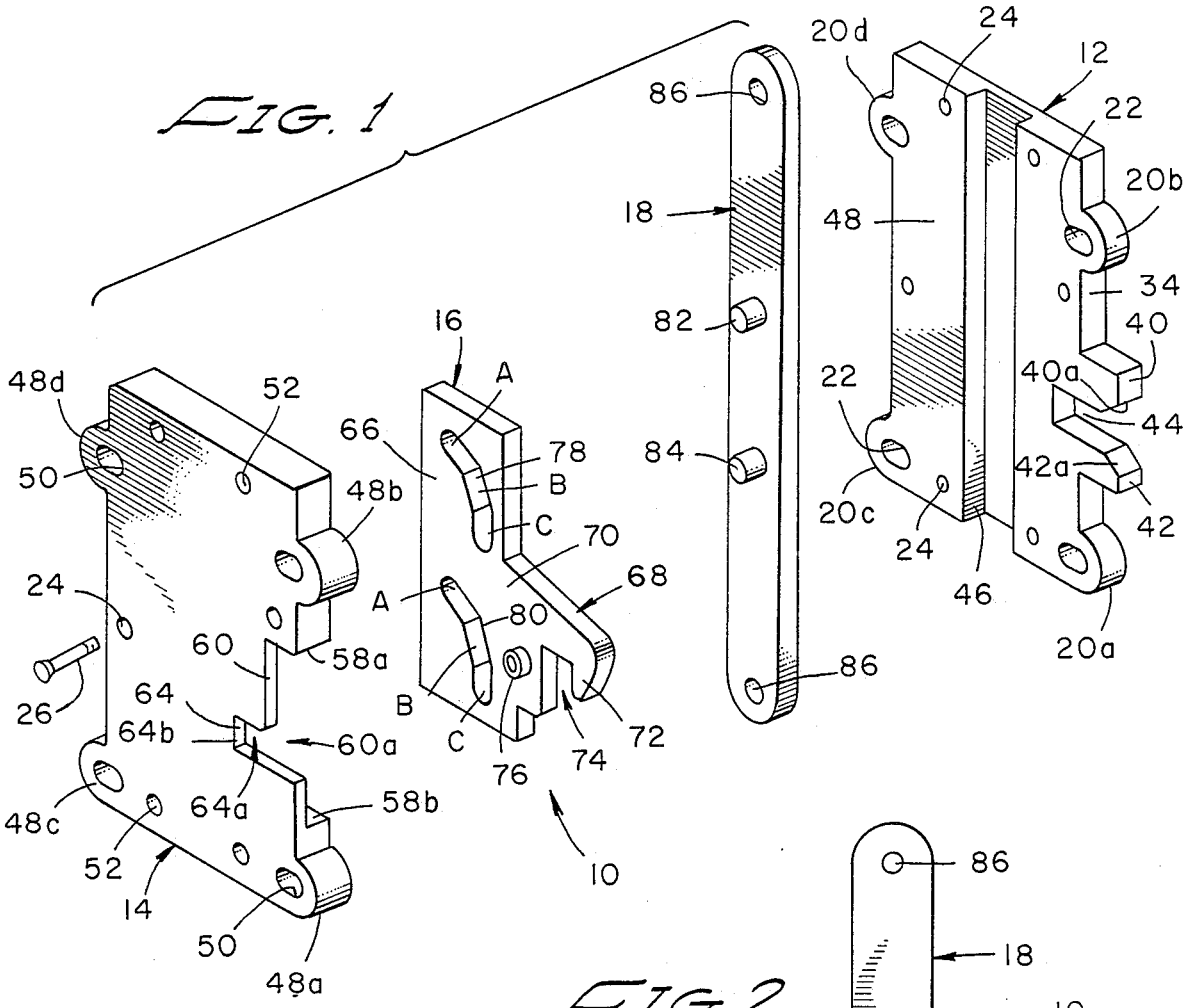
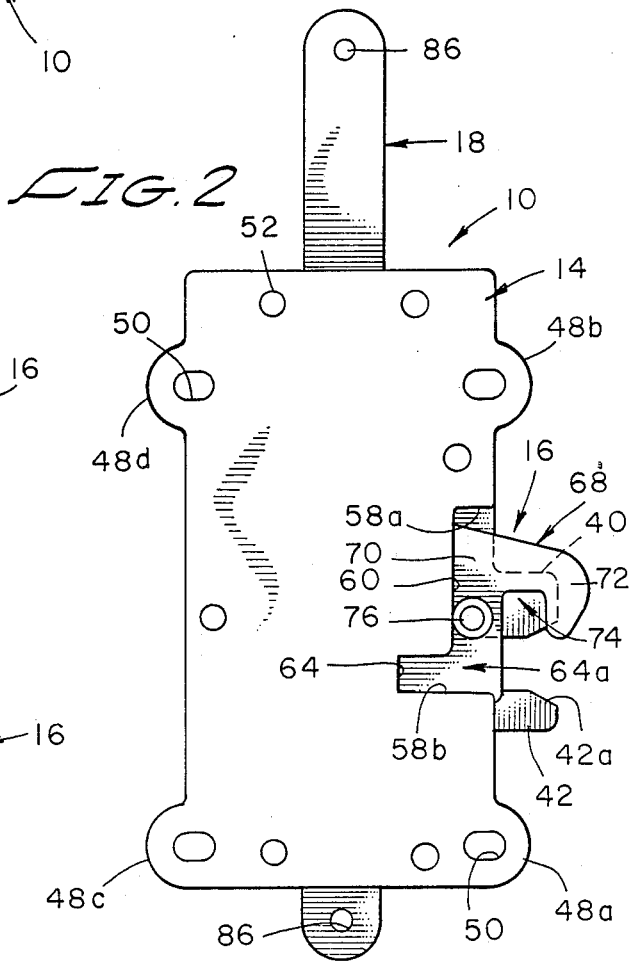
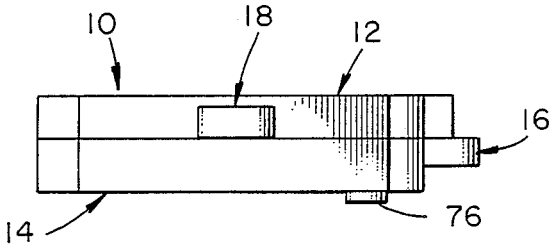
FIG. 4
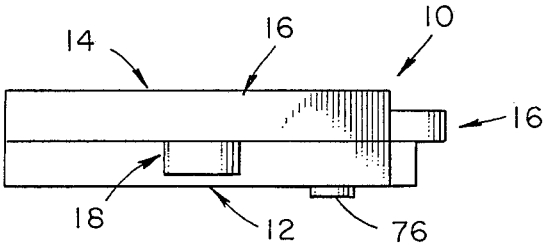
FIG. 5

LATCH MECHANISM

BACKGROUND OF THE INVENTION

1. Field of the Invention

This invention relates to a latch mechanism, and particularly to a latch mechanism used on a structure which is subjected to intense vibrational forces.

2. Background Discussion

In aircraft it is necessary to close doors, hatches and inspection covers to the cowlings or fuselage and latch them securely. Since aircraft, particularly helicopters, are subjected to intense vibrational forces, if the latching mechanism is improperly designed the vibration of the structure will cause the latch to open. Various latching mechanisms have been proposed to accomplish secure locking of the latch which generally call for a striker rod to be mounted on the frame of the fuselage with a hook member carried by the door. Upon closure of the door the hook member engages the striker rod and grasps it firmly. Complicated, and in many instances unreliable, locking mechanisms are then provided to secure the hook firmly in place, grasping the striker rod.

SUMMARY OF THE INVENTION

The present invention provides a reliable latch mechanism which includes means preventing or minimizing the likelihood of release of the hook member from the striker rod as a result of vibration. There are several features of this invention which contribute to its reliability, no single one of which is solely responsible for this desirable attribute. Without limiting the scope of this invention as expressed by the claims, its more prominent features will now be discussed briefly. After considering this discussion, and particularly after reading the section of this application entitled DETAILED DESCRIPTION OF THE PREFERRED EMBODIMENT, one will understand how the features of this invention provide a reliable latch mechanism which will not open when subjected to vibrational forces.

One feature of this invention is the mounting of the hook member within a recess in the body of the latch mechanism so that the hook member will move from an open position to a locked position along a right angle path of travel. The body of the latching mechanism has a groove along its perimeter with an open mouth that provides access to the striker rod. As the hook member moves along the first leg of the path of travel it grasps the striker rod and pulls it into the mouth of the groove as it reaches the right angle turn. Upon grasping the striker rod, the hook member then turns 90 degrees and moves along the second leg of the path, pulling the striker rod inwardly into the locked position.

Another feature of this invention is that the hook member is coupled to a cam which controls the path of travel of the hook member. An actuator element extending through the body of the latching mechanism engages the cam. This actuator element is manually movable rectilinearly in a reciprocal fashion to move the hook member between the opened and locked position.

The most important feature of this invention is that once the hook member has been moved into the locked position by the actuator element vibrational forces normally encountered in a helicopter or other aircraft will not result in accidentally releasing the hook member from the striker rod by moving the actuator element. In accordance with this invention, the cam surfaces which interact with the actuator element are designed so that there is some "over travel" that allows the actuator element to move a predetermined distance to and fro without moving the hook member. As a consequence, even if the actuator arm moves due to vibrational force, the hook member does not move, thereby maintaining its grasp on the striker rod to hold the striker rod firmly in the locked position.

The preferred embodiment of this invention illustrating all of its features will now be discussed in detail in connection with the following drawing.

BRIEF DESCRIPTION OF THE DRAWING

The drawing, wherein like numerals indicate like parts, depicts the preferred embodiment of this invention, in which:

FIG. 1 is an exploded perspective view of the latch mechanism of this invention;

FIG. 2 is a front elevational view of the latch mechanism of this invention with the hook member in the open position;

FIG. 4 is a side elevational view showing the top of the latch mechanism of this invention with the hook member in the open position;

FIG. 5 is a bottom view of the latch mechanism with the hook member in the open position;

DESCRIPTION OF THE PREFERRED EMBODIMENT

Figure 3:
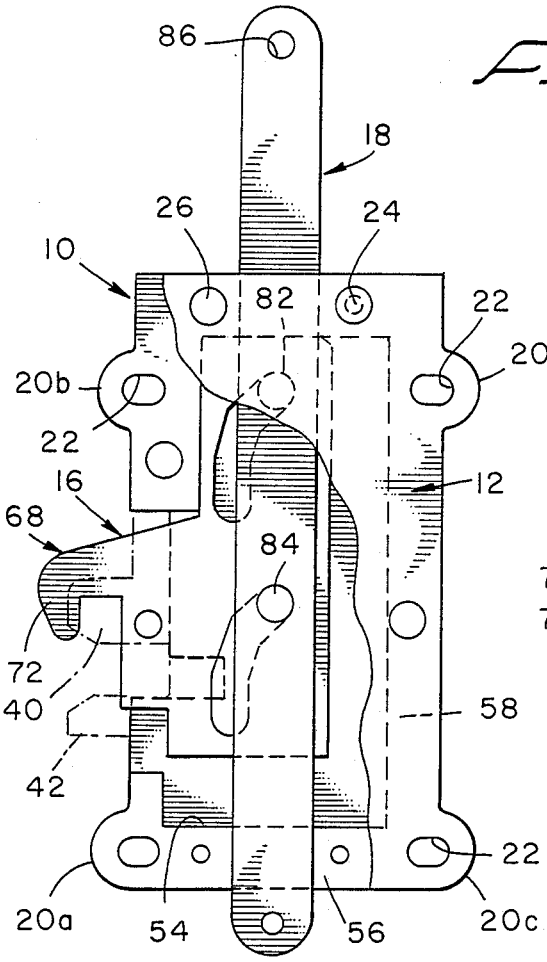
FIG. 3 is a rear elevational view, with sections broken away, of the latch mechanism of this invention with the hook member in the open position.

The latch mechanism 10 of this invention has four principal components: (1) A generally rectangularly shaped back plate 12, and (2) a generally rectangularly shaped front plate 14 having dimensions substantially the same as the dimensions of the back plate, (3) a hook member 16, and (4) an actuator bar 18. All these components are made of steel to enhance the durability and safety of the latch mechanism, except the front and back plates which are made from aluminum to save weight.

Figure 6:
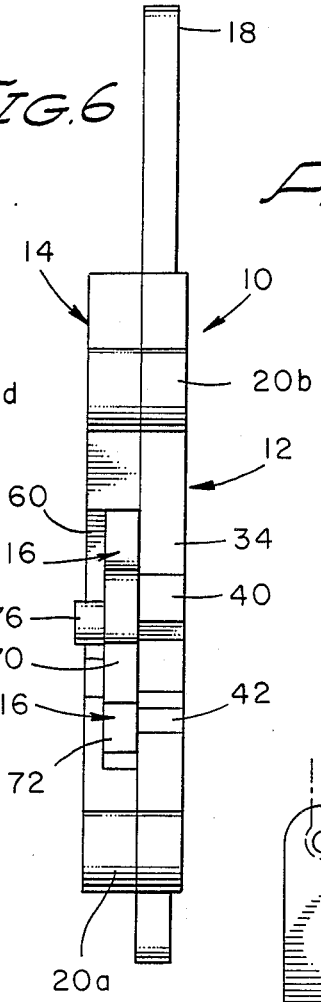
FIG. 6 is a side elevational view of the latch mechanism of this invention with the hook member in the open position.
Figure 8:
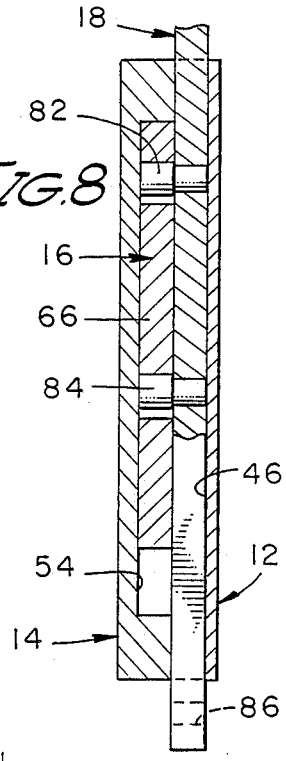
FIG. 8 is a cross-sectional view taken along line 8—8 of FIG. 7.
Figure 14:
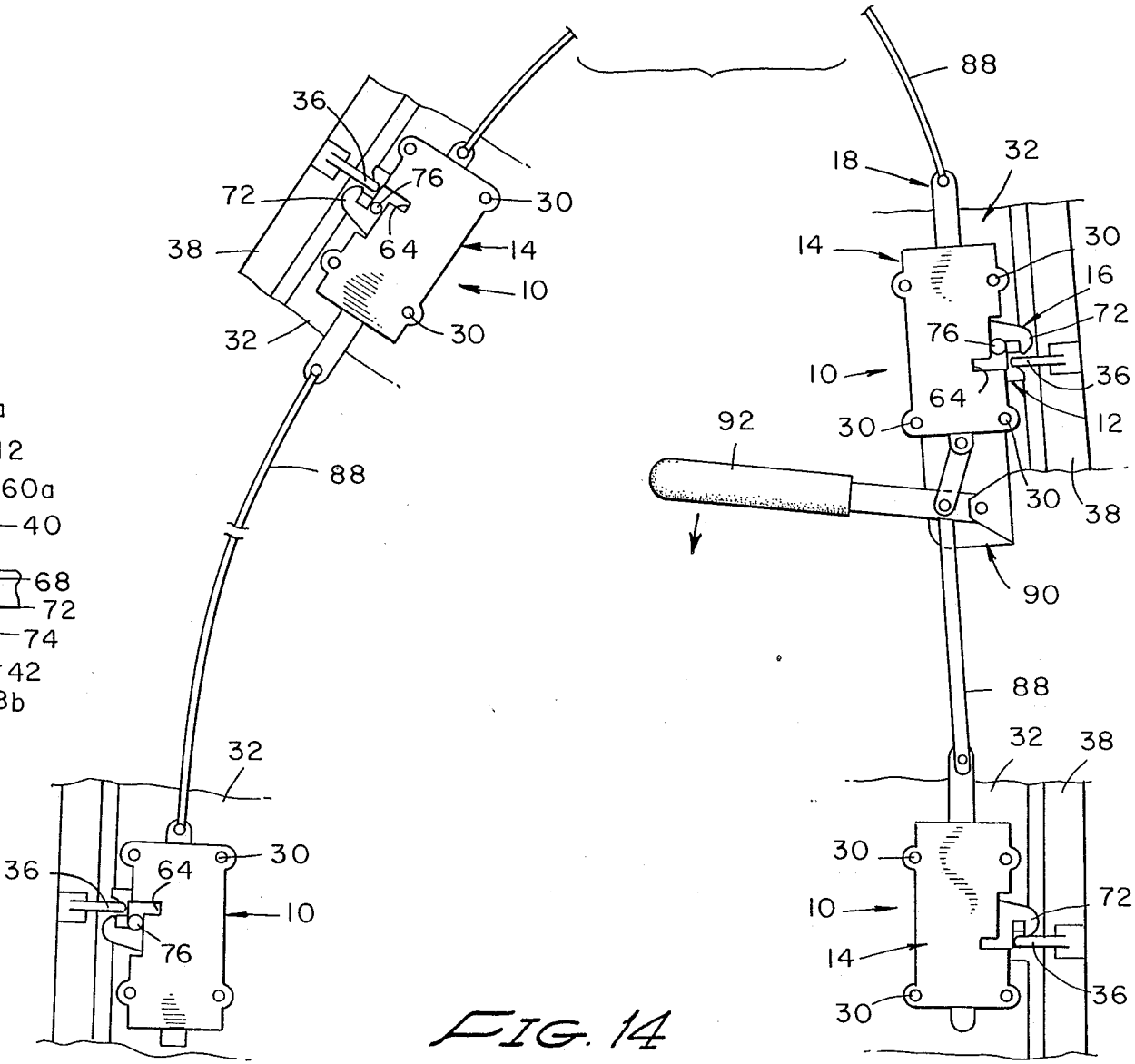
FIG. 14 is a side elevational view of a door to a helicopter with four latch mechanisms mounted to the door and engaging striker rods on the door frame. The four latch mechanisms are all opened and closed simultaneously.

As best illustrated in FIGS. 1, 3, and 6, the back plate 12 has four flanges 20*a*, 20*b*, 20*c*, and 20*d* with elongate holes 22 therein. Two of these flanges 20*a* and 20*c* are located opposite each other at two corners of the plate 12. The other two flanges 20*b* and 20*d* are offset slightly from the other two opposing corners. Around the perimeter are located spaced apart round holes 24 for receiving fastening members 26 for securing the front plate 14, and back plate 12 together. The flanges 20*a*–20*d* receive fasteners 30 (FIG. 14) for mounting the latch mechanism 10 to the helicopter door 32. As shown in FIG. 14, a striker bar 36 secured to the door frame 38 engages the latch mechanism upon closure of the door 32.

Along the side 34 of the back plate 1 which is adjacent the striker bar rod 36 upon closure of the door 32 are two outwardly projecting, spaced apart tongues 40 and 42 with the ends 40*a* and 42*a* of the tongues being tapered. A slight indentation 44 in the back plate 12 is formed between these two tongues. This indentation 44 receives the striker rod 36, with the tapered ends 40*a* and 42*a* of the tongues guiding the striker bar into the indentation.

There is a straight channel 46 generally of a rectangular configuration extending lengthwise along the central portion of the inner wall 48 of the back plate 12. This channel receives the actuator bar 18.

The front plate 14 includes four flanges 48*a*, 48*b*, 48*c* and 48*d*. Two of these 48*a* and 48*c* are mounted at corners of the plate and two, 48*b* and 48*d*, are offset slightly from the other two opposed corners. There are elongated holes 50 in the flanges 48*a*–48*d*, with the fasteners 30 passing therethrough. The front plate also includes holes 52.

A generally rectangular shaped recess 54 is formed in the inside wall 56 of the front plate 14. Surrounding this recess is a rim 58 which has terminal ends 58*a* and 58*b* opposite each other in the side 60 of plate 14 facing the striker bar 36. The recess 54 has an open side 60*a* defined by the ends 58*a* and 58*b* of the rim which, as will be explained in greater detail hereafter, serve as stops limiting the lateral movement of the hook member 16. Projecting inwardly into the recess 54 is a notch 64 with the open mouth 64*a* of the notch along the edge 60 of the front plate 14. This notch 64 receives the striker rod 36 when the door 32 is closed, with the button 64*b* of the notch acting as a stop.

Figure 9:
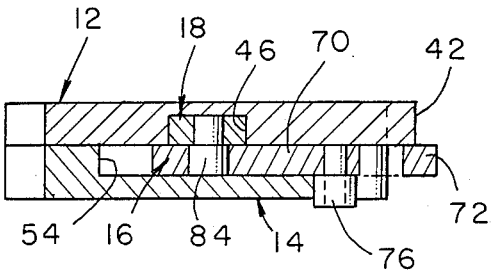
FIG. 9 is a cross-sectional view taken along line 9—9 of FIG. 7.
Figure 10:
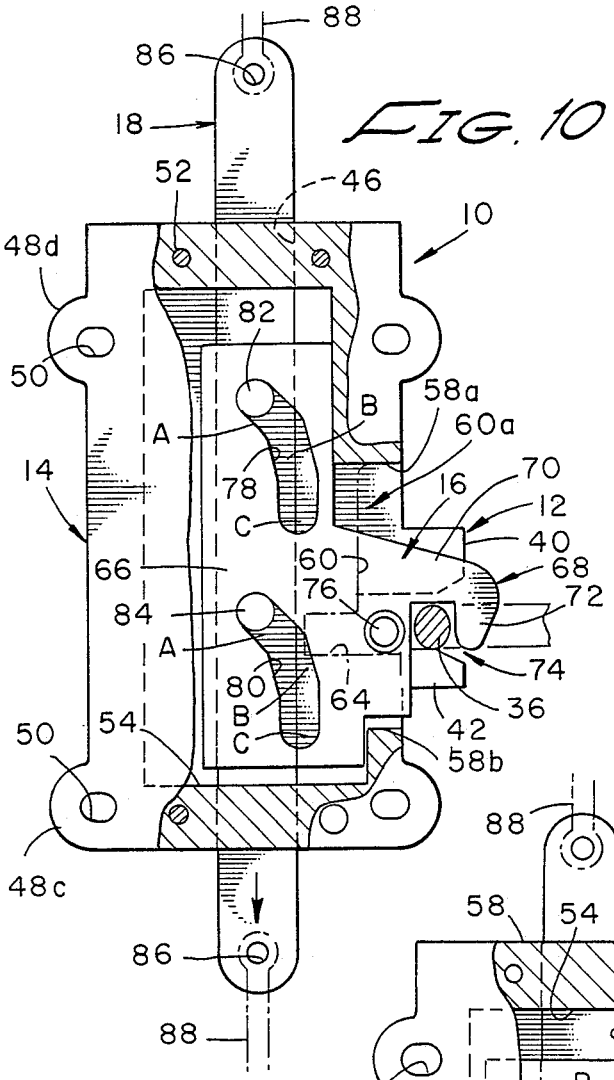
FIG. 10 is a front elevational view of the latching mechanism, with sections broken away, similar to that shown in FIG. 7, but with the hook member moved downward to bring the striker rod into the mouth of the hook member.
Figure 11:
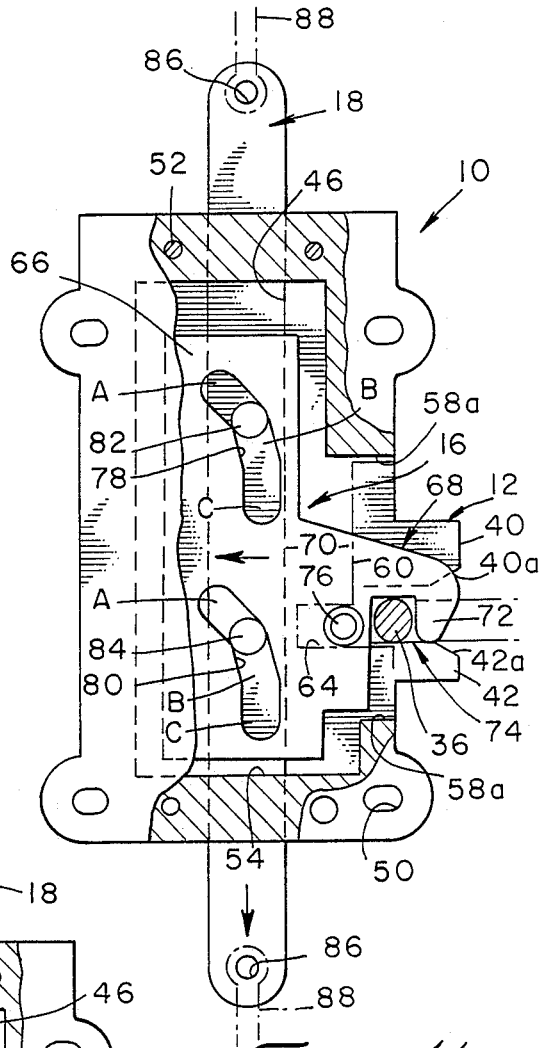
FIG. 11 is a front elevational view of the latch mechanism, with sections broken away, similar to that shown in FIG. 10 but with the hook member making a right turn as it moves along its path of travel.
Figure 12:
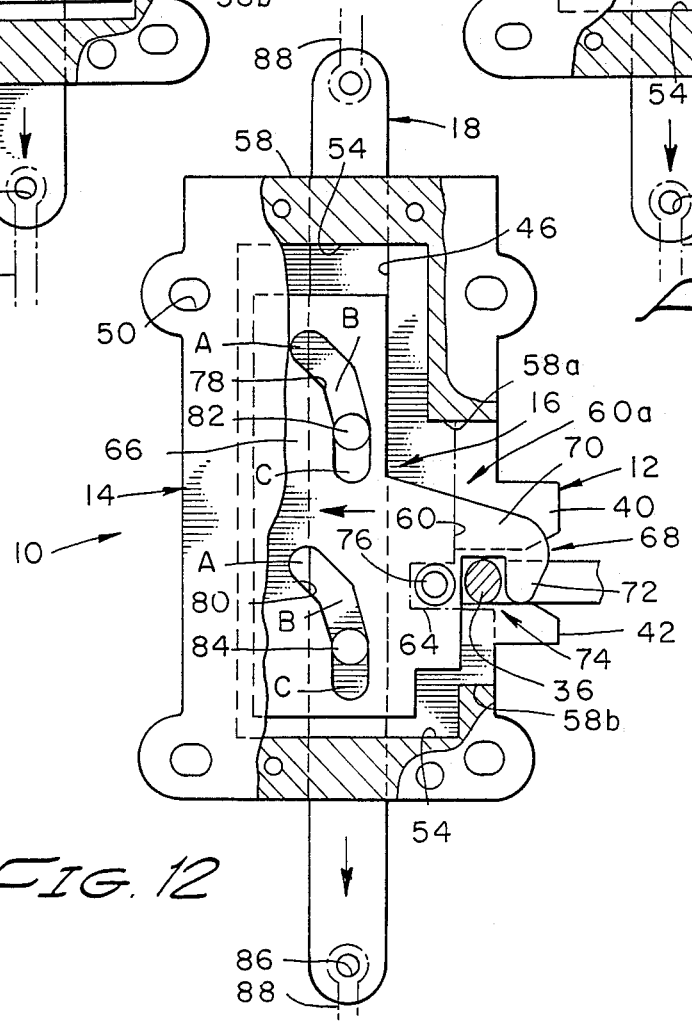
FIG. 12 is a front elevational view of the latch mechanism, with sections broken way, similar to that shown in FIG. 11 but with the hook member holding the striker rod in the locked position.
Figure 13:
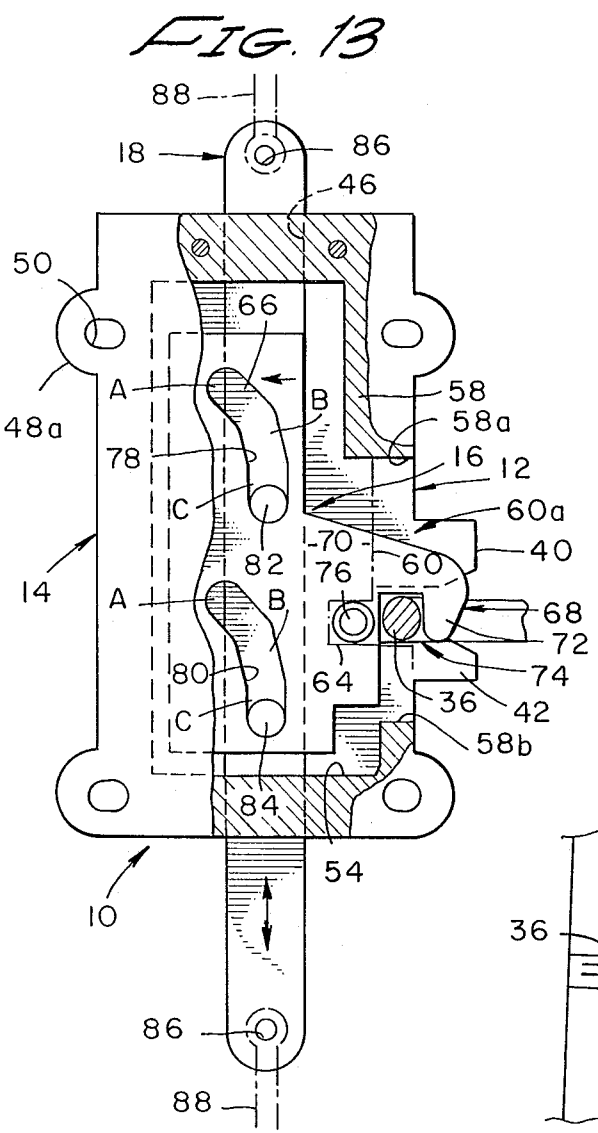
FIG. 13 is a front elevational view of the latch mechanism, with sections broken away, similar to that shown in FIG. 12 but with the actuator arm in the locked position.

As best shown in FIG. 1 and FIGS. 10 through 13, the hook member 16 has a base segment. 66 having a generally rectangular shape from which extends outwardly a hook section 68 comprising a shank 70 and a finger 72 generally at a right angle to the shank. The shank 70 is generally of an L-shaped hook structure which has an open mouth 74 with a diameter slightly greater than that of the striker rod 36. Extending outwardly from the face of the shank 70 is a roller 76 which rides along the edge 60 of the front plate 14 as the hook member 16 moves between the open position (FIG. 9) and lock position (FIG. 13). In the base segment 66 there are two essentially identically shaped openings 78 and 80. These openings 78 and 80 each provide three cam sections A, B and C, with the wall of these sections serving as cam surfaces that direct the movement of the hook member 16 along a generally right angle path of travel. As will be explained in greater detail hereinafter, section C of the openings 78 and 80 is carefully controlled so that the actuator bar 18 will be able to move slightly to and fro within the channel 46 without moving the hook member from a locked position to an open position.

The actuator bar 18 is a generally flat elongated element which has two pins 82 and 84 extending outwardly from its face. At each end of the bar is a hole 86 for connecting the bar to a suitable coupling linkage 88 (FIG. 14). Each pin 82 and 84 is displaced inwardly from the holes 86, with the displacement distance being about equal.

The principal components of the latch mechanism, the front plate 14, back plate 12, bar 8 and hook member 16 are assembled together so that the rectangular base segment 66 of the hook member 16 is received within the recess 54 in the front plate 14 with the pins 82 and 84 on the actuator bar 18 seated respectively in the openings 78 and 80 as shown in FIGS. 10–13. The actuator bar 18 is disposed within the channel 46 within the back plate 12 and the hook member 16 an actuator bar 18 are disposed between the front plate 14 and rear plate 12 which are aligned so that the holes 52 in the front plate are aligned with the holes 24 in the rear plate with fasteners 26 securing the two plates together.

Figure 7:
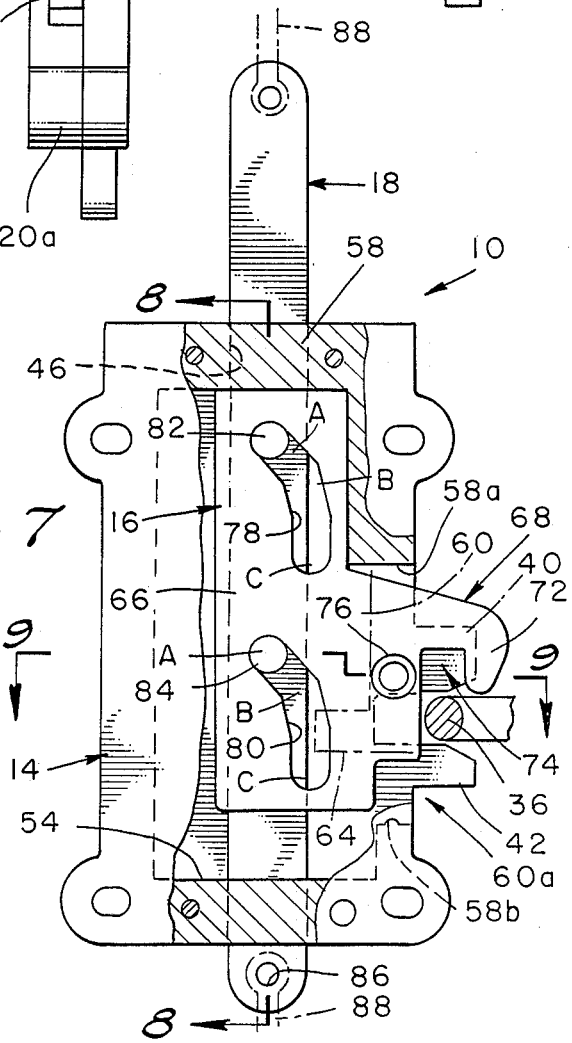
FIG. 7 is a front elevational view of the latch mechanism, with sections broken away, showing the striker rod entering the mouth of the hook mechanism.

In accordance with one of the principal features of this invention, the hook member 16 moves along a right angle path of travel between the fully open position as shown in FIG. 7 and the fully closed position shown in FIG. 13. In the fully open position shown in FIG. 7 the hook member 16 is displaced to the side of the notch 64, allowing the striker rod 36 to be moved into the open mouth 64*a* of the notch upon closure of the door 32. In this open position the actuator bar 18 is in a raised position and the pins 82 and 84 are seated in section A in these respective openings 78 and 80. With the striker rod 36 in the mouth 64*a* of the notch 64, the actuator bar 18 is pulled downwardly to move it from the position shown in FIG. 7 to the position shown in FIG. 10. The pins 82 and 84 simply push against the cam surfaces of the openings 78 and 80 to move the hook member 16 along a straight line, with the roller 76 riding along the edge 60 of the front plate 14.

As shown in FIG. 11, with continued movement of the actuator bar 18 in the downward direction, the pins 82 and 84 slide along the walls of sections A of openings 78 and 80 to allow the finger 72 to grasp the striker rod 36 and initiate inward movement of the hook member 16. This corresponds to turning the corner of the right angle path of travel of the hook member as it moves between the open and closed positions. As shown in FIG. 12, as the actuator bar 18 continues to be moved downwardly the pins 82 and 84 move from sections A to sections B of the openings 78 and 80 to change the direction of the movement of the hook member 16 so that it moves inwardly into the recess 54. The finger 72 then pulls the striker rod 76 into the notch 64 until the striker rod hits the button 64*b* of the notch 64. Further movement of the actuator bar 18, as illustrated by FIGS. 12 and 13, moves the pins from sections B into sections C of the openings 78 and 80. The latch mechanism is now in its fully closed position.

Reverse movement of the actuator bar 18 will move the hook member 16 along an identical path of travel but in a reverse direction, moving it from the locked position shown in FIG. 13 to the open position shown in FIG. 7. In accordance with one important feature of this invention, the actuator bar 18 can move from the position shown in FIG. 13 to the position shown in FIG. 12 without initiating movement of the hook member. Thus only when the pins 78 and 80 move from sections C into sections B of the openings 78 and 80 will opening of the latch mechanism occur. This is important in order to provide "over travel" in the latch mechanism 10 to compensate, or counteract, vibrational forces which may jar the actuator bar 18 loose from a locked position even though it would be undesirable to open the helicopter door 32. This feature can be more fully appreciated by considering the use of the latch mechanism 10 in the closure system 90 of the helicopter door 32 illustrated in FIG. 14.

The closure system 90 for the helicopter door 32 includes four of the latching mechanisms 10 mounted to the helicopter door 32 as discussed above. The latching mechanisms 10 are spaced apart on the perimeter of the door and located opposite striker rods 36 mounted on the door frame 38. The actuator bars 18 of each of these latch mechanisms 10 are connected by a linkage 88, with the ends of the linkage secured by fasteners (not shown) to the holes 86 of the actuator bars 18. Thus the actuator bars will move in unison.

A control handle 92 connected to one of the linkages 88 is used to move the bar 18 to lock or open the latch mechanisms 10. Upon movement of this handle 92 upwardly, the actuator bars 18 are moved upwardly through simultaneous movement of the linkages 88. (Some of the latching mechanisms 10 are situated so that the actuator bars 18 are moved in a downwardly direction to open the latch mechanism.) Downward movement of the handle 92 moves the actuator bars 18 in the opposite direction to bring the hook members 16 into the locked position shown in FIG. 13. When in this locked position, the handle 92 is coupled to a locking device (not shown) which holds it firmly in the locked or downward position. Notwithstanding, vibration or a shock to the fuselage of the helicopter could jar the handle 92 free of its locking device. If this occurred, the actuator bar 18 would be free to move as a result of the vibration. The actuator bar 18 could move the distance corresponding to the travel illustrated in FIGS. 12 and 13 without initiating movement of the hook member outwardly from the recess 54. This highly desirable feature thus provides a safeguard against accidental opening of the latch mechanism 10 of this invention.

SCOPE OF THE INVENTION

The above description presents the best mode contemplated for carrying out the present invention as depicted by the embodiment disclosed. The combination of the features illustrated by the embodiment provides the user with an improved latching mechanism. This invention is, however, susceptible to both modifications and alternate constructions from the embodiment shown in the drawing and described above. Consequently, it is not the intention to limit it to the embodiment disclosed. On the contrary, the intention is to cover all modifications and alternate constructions falling within the scope of this invention as generally expressed by the following claims.

What is claimed is:

1. A latching mechanism for holding a striker element or the like in a locked position, including a body member formed by first and second plate type members, the first plate type member having an elongated, linear channel therein and the second plate type member having a recess therein with an open side coextensive with an edge of said second plate type member, said first and second members being joined together so that the channel in said first plate member faces the recess of the second plate type member, and each of said first and second members having notches therein which form a groove in the body member for receiving a striker element upon the first and second members being joined together, with said groove having an open mouth proximate said edge, a movable hook member received within said recess and having a hook element extending outwardly from said plate type members through said open side of the recess, a first follower element which is adapted to ride along said edge of said second plate type member as the hook member moves, and a cam section on said hook member for controlling the movements of the hook member so that upon actuation, said hook members moves (a) rectilinearly along a first path from an open position with the hook element adjacent the groove but offset therefrom to allow the striker element to be received within the mouth of the groove to an intermediate position with the hook element covering the mouth of the groove and grasping the striker element, and (b) rectilinearly along a second path at a right angle with respect to the first path, with the hook member pulling the striker element inwardly into the groove to the locked position, and an actuator coupled to the hook member and seated in said channel in said first plate type member, and slidably movable therein, to move said hook member between said open and locked position, and including a second follower element which engages the cam section of the hook member, said cam section including a segment which allows said second follower element to move a predetermined distance laterally to enable the actuator element to move rectilinearly within the channel after the hook member is in the locked position without disengaging the grasp of the hook element from the striker element to maintain the hook member in the locked position.

2. The locking mechanism of claim 1 wherein the hook member has a base section including two spaced apart, generally curved openings aligned with each other and adjacent each other, and the actuator element includes two pins spaced apart and received within the openings, said pins acting as the second follower element.

3. A latch mechanism for holding a strike element or the like in a locked position, including:

a body member having at least one generally straight edge and a groove in the body member having an open mouth along said edge, said groove being disposed generally at a right angle with respect to said straight edge, a hook member mounted within the body member and movable therein between locked and unlocked positions, said hook member having a hook element which extends outwardly from the body, with the hook element offset with respect to the open mouth of the groove when the hook member is in the unlocked position to allow a striker element to be positioned at the mouth of the groove and grasping said striker element at said mouth of the groove and drawing said striker element toward the groove when the hook member is moved to the locked position where the striker element is pulled by the hook member into the groove, follower means coupled to the hook member which ride along the straight edge and then along the groove so that the hook member travels a path which has a right angle turn, with the hook element grasping the striker element pulling said striker element toward and into the groove as the hook member makes the right angle turn, and actuator means for moving the hook member between the unlocked and locked positions.

4. The latch mechanism of claim 3 wherein the hook member is coupled to the actuator means by pin means extending from the actuator means and into a generally curved opening in the hook member.

5. The latch mechanism of claim 4 wherein the opening has a predetermined shape that enables the actuator means to move after the hook member is in the locked position without disengaging the grasp of the hook element from the striker element to maintain the hook member in the locked position.

6. The latch mechanism of claim 3 including an enclosing structure which totally encloses the striker element upon said striker element being moved into the groove.

* * * * *